US010026347B2

(12) United States Patent
Xu et al.

(10) Patent No.: US 10,026,347 B2
(45) Date of Patent: Jul. 17, 2018

(54) ARRAY SUBSTRATE, DISPLAY PANEL AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Rui Xu, Beijing (CN); Xiaochuan Chen, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 132 days.

(21) Appl. No.: 15/086,945

(22) Filed: Mar. 31, 2016

(65) Prior Publication Data

US 2017/0069280 A1 Mar. 9, 2017

(30) Foreign Application Priority Data

Sep. 8, 2015 (CN) ..... 2015 1 0568036

(51) Int. Cl.
*G09G 3/36* (2006.01)
*G09G 3/20* (2006.01)

(52) U.S. Cl.
CPC ..... *G09G 3/20* (2013.01); *G09G 2310/0267* (2013.01); *G09G 2310/0275* (2013.01); *G09G 2310/0297* (2013.01)

(58) Field of Classification Search
CPC ..... G09G 3/20; G09G 2310/0297; G09G 2310/0267; G09G 2310/0275
(Continued)

(56) References Cited

U.S. PATENT DOCUMENTS 6,424,328 B1 * 7/2002 Ino ..... G09G 3/3614 345/100
2004/0179014 A1 9/2004 Nakano et al.
(Continued)

FOREIGN PATENT DOCUMENTS

CN 1525217 9/2004
CN 101487962 7/2009
(Continued)

OTHER PUBLICATIONS

Office Action from corresponding Chinese Application No. 201510568036.4, dated Apr. 5, 2017 (9 pages).

*Primary Examiner* — Srilakshmi K Kumar
*Assistant Examiner* — Chineyere Wills-Burns
(74) *Attorney, Agent, or Firm* — Harness, Dickey & Pierce, P.L.C.

(57) ABSTRACT

Embodiments of the present disclosure provide an array substrate, a display panel and a display device, which may simplify bezels at three sides of the display panel and achieve the effect of almost zero bezel visually. Because a GOA design is not adopted, the cost of a drive circuit may be reduced, and poor relevant reliability caused by the GOA may be avoided. The array substrate comprises a display area and a drive circuit area. The display area includes: a plurality of pixel units, a plurality of data lines, and a plurality of gate lines. The drive circuit area includes: a drive module being configured to provide signals to data lines and gate lines. The drive circuit area is outside of the display area and close to the data lines. The embodiments of the present disclosure are used to manufacture the array substrate, the display panel and the display device.

15 Claims, 7 Drawing Sheets

(58) Field of Classification Search
USPC ..... 345/100
See application file for complete search history.

(56) References Cited

U.S. PATENT DOCUMENTS

| | | | | |
|---|---|---|---|---|
| 2007/0091044 | A1* | 4/2007 | Park | G09G 3/3648 345/88 |
| 2009/0174649 | A1* | 7/2009 | Kim | G09G 3/3688 345/104 |
| 2011/0279418 | A1 | 11/2011 | Han et al. | |
| 2013/0181968 | A1* | 7/2013 | Uemura | G02B 27/2214 345/212 |
| 2013/0257837 | A1* | 10/2013 | Wang | G09G 3/3696 345/211 |
| 2014/0191931 | A1 | 7/2014 | Kim | |
| 2014/0210875 | A1* | 7/2014 | Sumi | H04N 13/0409 345/694 |
| 2016/0203753 | A1* | 7/2016 | Hwang | G09G 3/2092 345/212 |
| 2017/0061853 | A1 | 3/2017 | Yang et al. | |

FOREIGN PATENT DOCUMENTS

| | | |
|---|---|---|
| CN | 102243838 | 11/2011 |
| CN | 202075968 | 12/2011 |
| CN | 202210402 | 5/2012 |
| CN | 102543028 | 7/2012 |
| CN | 103927970 | 7/2014 |
| CN | 104680967 | 6/2015 |
| CN | 104751766 | 7/2015 |
| CN | 204536699 | 8/2015 |

* cited by examiner

ARRAY SUBSTRATE, DISPLAY PANEL AND DISPLAY DEVICE

CROSS-REFERENCE TO RELATED APPLICATION

This application claims the benefit and priority of Chinese Patent Application No. 201510568036.4 filed Sep. 8, 2015. The entire disclosure of the above application is incorporated herein by reference.

FIELD

The present disclosure generally relates to the field of display technologies, and more particularly, to an array substrate, a display panel and a display device.

BACKGROUND

This section provides background information related to the present disclosure which is not necessarily prior art.

FIG. 1 is a schematic structural diagram of an array substrate in the prior art. As shown in FIG. 1, the array substrate includes a plurality of R (red) subpixel units, G (green) subpixel units and B (blue) subpixel units arranged in an array and defined by intersected data lines and gate lines. In figures, D1, D2, D3 and so on illustrate data lines, and G1, G2, G3 and so on illustrate gate lines. One end of the data lines is provided with an integrated circuit (IC) for providing data signals to the data lines, and one end or two ends of the gate lines are provided with a GOA (Gate driver On Array) circuit for providing gate scanning signals to the gate lines.

In the prior art, a GOA circuit is fabricated on an array substrate to replace an externally connected driver chip, for reducing the production process procedures, lowering the product process cost, and improving the integration level of a liquid crystal panel. However, the GOA circuit integrated into the array substrate, its peripheral wiring connecting the gate lines and the GOA circuit, or the like need extra space, which is unavailable for display, thus peripheral area of the array substrate increases and it is difficult to meet the demands of the consumer market for narrow bezel or even zero bezel display devices. In addition, it is necessary to consider signal matching between the GOA circuit and the gate lines. Therefore, the cost of an array substrate drive is higher, and the design of the GOA circuit may cause poor relevant reliability.

SUMMARY

This section provides a general summary of the disclosure, and is not a comprehensive disclosure of its full scope of all of its features.

Embodiments of the present disclosure provide an array substrate, a display panel and a display device, which may simplify bezels at three sides of the display panel and achieve the effect of almost zero bezel visually. Because no GOA circuit is used for gate drive, it is unnecessary to consider signal matching between the GOA circuit and the gate lines, the cost of a drive circuit may be reduced, and poor relevant reliability caused by the design of the GOA circuit may be avoided for the whole display device.

According to a first aspect of the present disclosure, there is provided an array substrate, comprising: a display area and a drive circuit area. The display area includes: a plurality of pixel units being arranged in an array; a plurality of data lines being arranged in parallel with each other and connected to the plurality of pixel units; and a plurality of gate lines being arranged in parallel with each other and connected to the plurality of pixel units. The plurality of data lines intersects with the plurality of gate lines. The drive circuit area includes: a drive module being configured to provide data signals to the plurality of data lines and provide gate scanning signals to the plurality of gate lines. The drive circuit area is outside of the display area and close to the data lines.

In the embodiments of the present disclosure, the drive module comprises N first multiplexers. Each of the first multiplexers is configured to output the gate scanning signals to X gate lines, wherein the total number of the gate lines is X*N.

In the embodiments of the present disclosure, the drive module further comprises a timing controller which includes X gate scanning signal output pins, and the X gate scanning signal output pins are connected to each of the first multiplexers.

In the embodiments of the present disclosure, the first multiplexer comprises X first switching transistors. First electrodes of the X first switching transistors are connected to the X gate scanning signal output pins of the timing controller, second electrodes are connected to the X gate lines, and control electrodes are connected to a control circuit in the drive module.

In the embodiments of the present disclosure, the drive module comprises M second multiplexers. Each of the second multiplexers is configured to output the data signals to the X data lines, wherein the total number of the data lines is X*M.

In the embodiments of the present disclosure, the drive module further comprises a timing controller comprising X data signal output pins, and the X data signal output pins are connected to each of the second multiplexers.

In the embodiments of the present disclosure, the second multiplexer comprises X second switching transistors, first electrodes of the X second switching transistors are connected to the X data signal output pins of the timing controller, second electrodes are connected to the X data lines, and control electrodes are connected to a control circuit in the drive module.

In the embodiments of the present disclosure, each of the plurality of pixel units comprises X subpixel units being arranged along a direction of the data lines.

In the embodiments of the present disclosure, each of the plurality of pixel units comprises X subpixel units being arranged along a direction of the gate lines.

In the embodiments of the present disclosure, X=3.

According to a second aspect of the present disclosure, there is provided a display panel which comprises the array substrate of any one of the foregoing claims.

According to a third aspect of the present disclosure, there is provided a display device which comprises the display panel.

In the array substrate provided by the embodiments of the present disclosure, the drive circuit area close to one end of the data lines comprises the drive module providing signals to the data lines and the gate lines so that all signals required for driving the pixel units in the array substrate to display may be educed from one end of a data pad, and therefore it is unnecessary to provide structures such as the GOA circuit and peripheral wirings or the like at two ends of the gate lines and at the other end of the data lines in the array substrate, three sides of the bezel in the array substrate may be reduced. When a user views the contents displayed on the display panel, usually the user may only notice whether or not there are bezels at the upward side and two horizontal sides of the panel, but less likely notice the bezel at the bottom of the panel. Therefore, it is possible to achieve the effect of almost zero bezel visually by using the display panel of the array substrate provided by the embodiments of the present disclosure, thereby meeting the demands of the current market for narrow bezel or even zero bezel display panels.

Also, because no GOA circuit is used for the gate of the foregoing array substrate, it is unnecessary to consider the matching design of output signals from the GOA circuit, the cost of the drive circuit may be reduced, and poor relevant reliability caused by the design of the GOA circuit may be avoided for the whole display device.

In addition, in the prior art, a bezel-free display device is implemented by means of optical conversion of backlight film material. However, relatively high demanding film material significantly increases the cost of the display device, and only a small viewing angle is provided for the user. However, the array substrate and the display panel provided by the embodiments of the present disclosure can achieve the effect of zero bezel at three sides without relying on the backlight film material, and mass production conditions in the prior art may be continued to use to reduce the cost.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts or features throughout the several views of the drawings.

COMPONENT LISTS

01—array substrate; 01*a*—display area; 01*b*—drive circuit area; 10—data line; 11—data line signal lead; 20—gate line; 21—gate line lead; 22—gate line signal lead; 30—drive module; 31—first multiplexer; 32—second multiplexer; 33—third multiplexer; 34—fourth multiplexer; 35—drive IC; 351—first output pin; 352—second output pin; 353—third output pin; 354—fourth output pin; 40—pixel unit; 41—sub-pixel unit.

DETAILED DESCRIPTION

Example embodiments will now be described more fully with reference to the accompanying drawings.

It is to be pointed out that, unless otherwise defined, all terms (comprising technical and scientific terms) used in the embodiments of the present disclosure have the same meaning as commonly understood by those skilled in the art to which this disclosure belongs. It will be further understood that terms, such as those defined in commonly used dictionaries, should be interpreted as having a meaning that is consistent with their meaning in the context of the relevant art and will not be interpreted in an idealized or overly formal manner unless expressly so defined herein.

In addition, the orientations or positions represented by the terms of "up", "down" and the like used in the specification and claims of this disclosure are based on the accompanying figures, they are merely for easily describing embodiments instead of being intended to indicate or imply the device or element to have a special orientation or to be configured and operated in a special orientation. Thus, they cannot be considered as limiting of the present disclosure.

Figure 1:
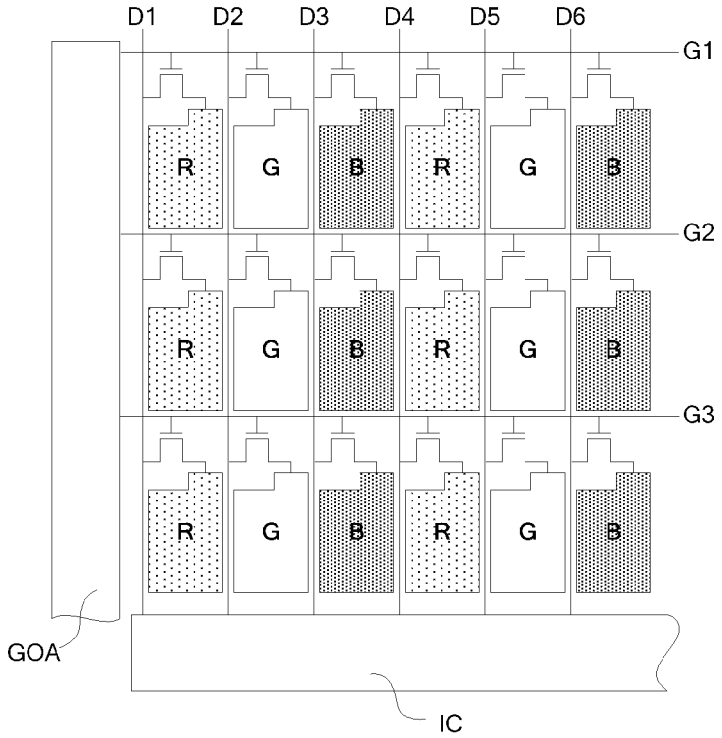
FIG. 1 is a schematic structural diagram of an array substrate in the prior art.
Figure 2:
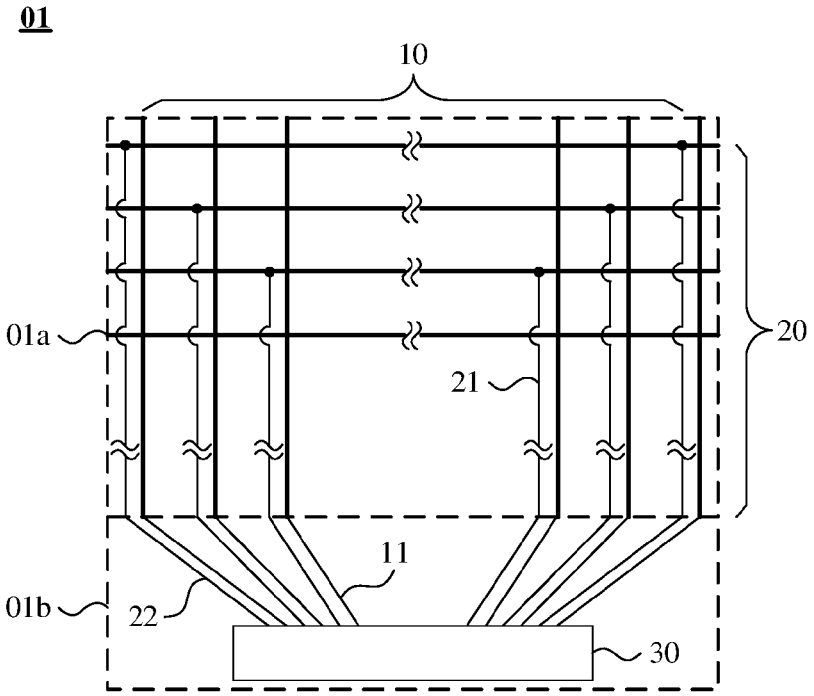
FIG. 2 is a schematic diagram of an array substrate according to a first embodiment of the present disclosure.

FIG. 2 is a schematic diagram of an array substrate according to a first embodiment of the present disclosure. The first embodiment of the present disclosure provides an array substrate 01 which includes: a display area 01*a* and a drive circuit area 01*b*. The display area 01*a* includes: a plurality of pixel units 40 being arranged in an array; a plurality of data lines 10 being arranged in parallel with each other and connected to the plurality of pixel units 40; and a plurality of gate lines 20 being arranged in parallel with each other and connected to the plurality of pixel units 40. The plurality of data lines 10 intersects with the plurality of gate lines 20. The drive circuit area 01*b* includes: a drive module 30 being configured to provide data signals to the plurality of data lines 10 and provide gate scanning signals to the plurality of gate lines 20. The drive circuit area 01*b* is outside of the display area 01*a* and close to the data lines 10.

As shown in FIG. 2, in the embodiments of the present disclosure, specifically, the array substrate 01 may include: the display area 01*a* and the drive circuit area 01*b* outside of the display area 01*a* and close to one end of the data lines. The display area 01*a* includes: a plurality of intersected data lines 10 and gate lines 20; and gate line leads 21 arranged along the direction of the data lines and successively connected to each of the gate lines 20. The drive circuit area 01*b* includes: a drive module 30; gate line signal leads 22 successively connected to the drive module 30 and each of the gate line leads 21 to input a gate scanning signal to the gate line leads 21; and data line signal leads 11 successively connected to the drive module 30 and each of the data lines 10 to input a data signal to the data lines 10. In the embodiments of the present disclosure, the data signal may be also referred to as a source signal because it may be provided to a source of a transistor. The drive circuit area 01*b* is close to one end of the data lines, which may ensure that no large included angle is generated between the data line signal leads 11 and the data lines 10 connected therewith, and that the negative impact of the data line signal leads 11 on the transmission of the data signal may be reduced, as compared to the drive circuit area 01*b* close to one end of the gate lines.

Taking the direction as shown in FIG. 2 as an example, the gate lines 20 are arranged along the transverse direction, and the gate line leads 21 are arranged along the longitudinal direction. In order to avoid adding extra composition process and overall number of layers of the array substrate, the gate line leads 21 and the data lines 10 may be disposed on the same layer so that the gate line leads 21 disposed in parallel with the data lines 10 are also formed when the data lines 10 are formed by means of the composition process. Via holes (see black solid dots in FIG. 2) may be disposed at a gate insulator layer positioned between the layer including the gate lines 20 and the layer including the data lines 10 so that the gate line leads 21 are correspondingly connected with the gate lines 20 to transmit the gate scanning signals. Of course, the gate line leads 21 and the data lines 10 may be disposed on different layers, which is not limited in the embodiments of the present disclosure.

The gate line leads 21 may be first disposed on the substrate surface of the array substrate, then the insulating layer covering the gate line leads 21 and the gate lines 20 are successively formed over the gate line leads 21, and, via holes are reserved when forming the insulating layer so as to correspondingly connect gate line leads 21 with the gate lines 20.

Furthermore, the embodiments of the present disclosure do not limit the manner of connection between the gate line leads 21 and the gate line signal leads 22. When they are positioned on different layers separated by the insulating layer, the gate line leads 21 may be correspondingly connected with the gate line signal leads 22 by means of via holes disposed in the insulating layer. When they are positioned on the same layer, the gate line signal leads 22 may be formed at the same time when the gate line leads 21 are formed. The gate line leads 21 and the gate line signal leads 22 may form an integrative structure but are respectively positioned in the display area 01*a* and the drive circuit area 01*b*.

The embodiments of the present disclosure do not limit the manner of connection between the data lines 10 and the data line signal leads 11 either, which is not repeated herein because various manners of connection between the gate line leads 21 and the gate line signal leads 22 may be taken for reference.

In the foregoing array substrate 01, the drive module 30 may include electronic components such as a drive IC for generating the data signals and the gate scanning signals or the like to separately provide the corresponding signal to the data lines 10 and the gate lines 20.

In the array substrate 01 provided by the embodiments of the present disclosure, the drive circuit area 01*b* close to one end of the data lines 10 comprises the drive module 30 separately providing signals to the data lines 10 and the gate lines 20 so that all signals required for driving the pixel units in the array substrate 01 to display may be educed from one end of a data pad, and therefore it is unnecessary to provide structures such as the GOA circuit and peripheral wirings or the like at two ends of the gate lines and at the other end of the data lines in the array substrate, three sides of the bezel may be reduced. When a user views the contents displayed on the display panel, usually the user may only notice whether or not there are bezels at the upward side and two horizontal sides of the panel, but less likely notice the bezel at the bottom of the panel. Therefore, it is possible to achieve the effect of almost zero bezel visually by using the display panel of the array substrate 01 provided by the embodiments of the present disclosure, thereby meeting the demands of the current market for narrow bezel or even zero bezel display panels.

The foregoing array substrate does not include the GOA circuit, and thus it is unnecessary to consider matching of output signals from the GOA circuit. The cost of the drive circuit may be reduced, and poor relevant reliability caused by the GOA circuit may be avoided for the display panel.

In the prior art, a bezel-free display device is implemented by means of optical conversion of backlight film material. However, the optical conversion of backlight film material is relatively high demanding for film material, the cost of the display device significantly rises, and only a small viewing angle is provided for the user. By using the display panel of the array substrate provided by the embodiments of the present disclosure, bezels at the top and at two horizontal sides may be reduced, the effect of zero bezel at three sides may be achieved without relying on the visual effect of the backlight film material, and mass production conditions in the prior art may be continued to use to reduce the cost because no new process is introduced.

The following will describe in detail a concrete manner through which the drive module 30 in the array substrate 01 separately outputs signals to the data lines 10 and the gate lines 20.

Figure 3:
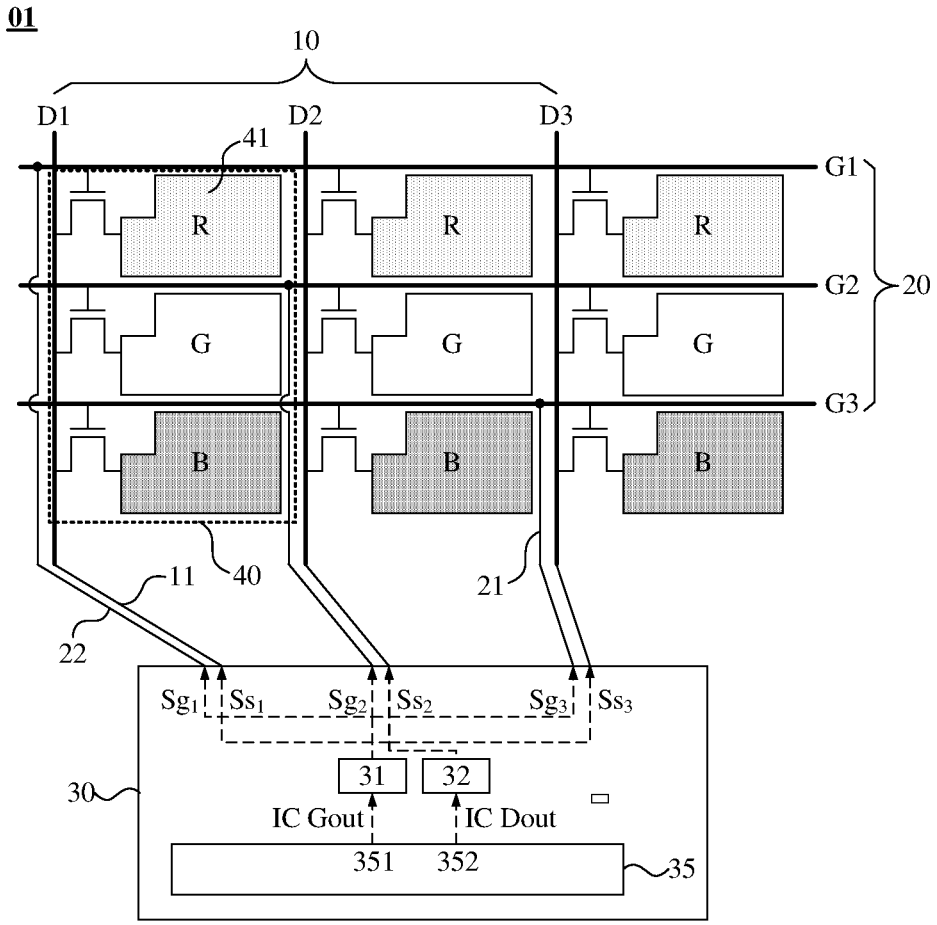
FIG. 3 is a schematic diagram of a first structure of the array substrate as shown in FIG. 2.

FIG. 3 is a schematic diagram of a first structure of the array substrate 01 as shown in FIG. 2.

In the structure, the drive module 30 includes: N first multiplexers 31. Each of the first multiplexers 31 is configured to output the gate scanning signals to X gate lines 20, wherein X*N is the total number of the gate lines. The drive module 30 further includes a timing controller comprising X gate scanning signal output pins, and the X gate scanning signal output pins are connected to each of the first multiplexers 31. The first multiplexer 31 includes X first switching transistors. First electrodes of the X first switching transistors are correspondingly connected to the X gate scanning signal output pins of the timing controller, second electrodes are correspondingly connected to the X gate lines 20, and control electrodes are connected to a control circuit in the drive module 30. Each of the plurality of pixel units 40 includes X subpixel units 41 arranged along the direction of the data lines 10. And X=3.

In the embodiments of the present disclosure, as shown in FIG. 3, specifically, the display area 01*a* includes: a plurality of pixel units 40 arranged in an M*N array. Each of the pixel units 40 includes X subpixel units 41 arranged along the direction of the data lines. The total number of the data lines 10 is M, and the total number of the gate lines 20 is X*N, wherein each of X, N and M is a positive integer. Starting from the first gate line signal lead 22, every X gate line signal leads 22 arranged in order constitute a set of gate line signal leads. The drive module 30 includes: a drive IC 35; and N first multiplexers 31 successively connected with each set of gate line signal leads. Each of the first multiplexers 31 is configured to output corresponding X gate scanning signals (successively marked as Sg1~SgX, in the figure X is equal to 3 as an example) to X gate line signal leads 22. The drive IC 35 includes a control circuit to control the plurality of first multiplexers 31.

The X subpixel units 41 in each of the pixel units 40 may be, for example, three subpixel units R, G and B as shown in FIG. 3, namely X is equal to 3; or four subpixel units R, G, B and W (white) or R, G, B and Y (yellow), namely X is equal to 4. The embodiments of the present disclosure do not limit the total number of the subpixel units 41 in each of the pixel units 40, and the design of an existing display panel or display device may be continued to use.

The connection manners between drive transistors in each of the subpixel units 41 and the data lines 10 and the gate lines 20 are separately illustrated merely by exemplary circuit symbols of thin film transistors (TFT) in FIG. 3. The concrete structure of the TFT may be a bottom-gate type or a top-gate type, or the structure of the TFT may be a dual-gate type when the foregoing array substrate 01 specifically is a low temperature poly silicon (LTPS) TFT array substrate. The TFT structure may continue to use the prior art, and the concrete structure thereof is not repeated herein.

See FIG. 3, the arrangement manner of the foregoing sub-pixels is a triple gate, namely three subpixel units 41 arranged along the direction of the data lines and positioned in one pixel unit 40 are separately controlled by three gate lines 20. In this way, one data line 10 may be employed to transmit signals to an entire column of subpixel units 41 along the direction of the gate lines 20, and the input mode of the data signal for each of the subpixel units 41 may be simplified.

The foregoing multiplexer (MUX) refers to a circuit capable of selecting any plex according to the need in the process of multiplex data transmission, which is also referred to as a data selector or a multi-way switch.

In the first embodiment of the present disclosure, by means of N first multiplexers 31, the corresponding gate scanning signals may be provided to X*N gate lines 20. The total number of output pins for transmitting signals from the drive IC 35 to the first multiplexers 31 is N.

If the first multiplexers 31 are not used and the drive IC 35 directly provides the gate scanning signals for the gate line signal leads 22, the drive IC 35 needs X*N output pins (namely electronic pins of the IC for outputting signals) to provide the corresponding gate scanning signals, namely more output pins are required. The total number of the pins directly affects the cost of the drive IC. The larger the total number of the pins is, the higher the cost of the drive IC is, which causes that the cost of the array substrate and the display panel also increases, to the disadvantage of reduction of the cost of the display device. In the embodiments of the present disclosure, due to use of N first multiplexers 31, (X−1)*N pins are saved and thus the cost of the drive IC is reduced.

The following describes the concrete structure of the first multiplexers 31 and a concrete manner through which the drive IC 35 outputs signals to N first multiplexers 31.

As shown in FIG. 3, the drive IC 35 specifically includes: N first output pins 351 successively outputting N first gate control signals (IC Gout1, IC Gout2 . . . IC GoutN) to N first multiplexers 31; and a timing controller outputting N sets of timing signals to N first multiplexers 31, where each set of timing signals include three signals (Gout1, Gout2 and Gout3) as the gate scanning signals.

Figure 4:
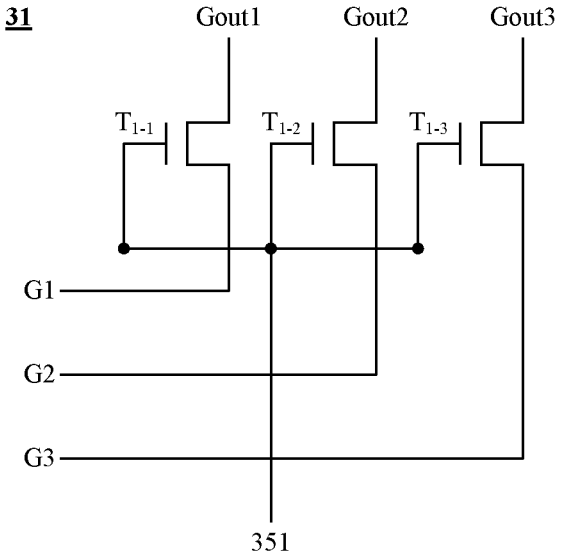
FIG. 4 is a schematic structural diagram of a first multiplexer of the array substrate as shown in FIG. 3.

FIG. 4 is a schematic structural diagram of the first multiplexers 31 of the array substrate 01 as shown in FIG. 3. As shown in FIG. 4, each of the first multiplexers 31 includes X first switching transistors (successively marked as T1-1~T1-X, in the figure X is equal to 3 as an example). Each of the first output pins 351 is connected to gates of X first switching transistors. X outputs of the timing controller is separately connected with sources of the X first switching transistors to separately output, to the sources of the X first switching transistors, the timing signals Gout1~GoutX, namely the corresponding gate scanning signals (successively marked as G1~GX, in the figure X is equal to 3 as an example). Here, an example is taken for description in which the control electrode of the switching transistor serves as the gate, the first electrode serves as the source and the second electrode serves as the drain. However, such a connection mode does not constitute a limitation on the present disclosure, for example, the first electrode may be the drain and the second electrode may be the source. In addition, in the figure, an example is taken for description in which the first output pins 351 are simultaneously connected to the gates of three first switching transistors. However, the total number of the first switching transistors connected to one first output pin 351 is not limited hereby, and it may be one or more. It is to be understood that the total number is related to the control accuracy and cost. For example, when one first output pin 351 is connected to one first switching transistor, a more accurate on/off control is available but the hardware cost may also be added.

Figure 5:
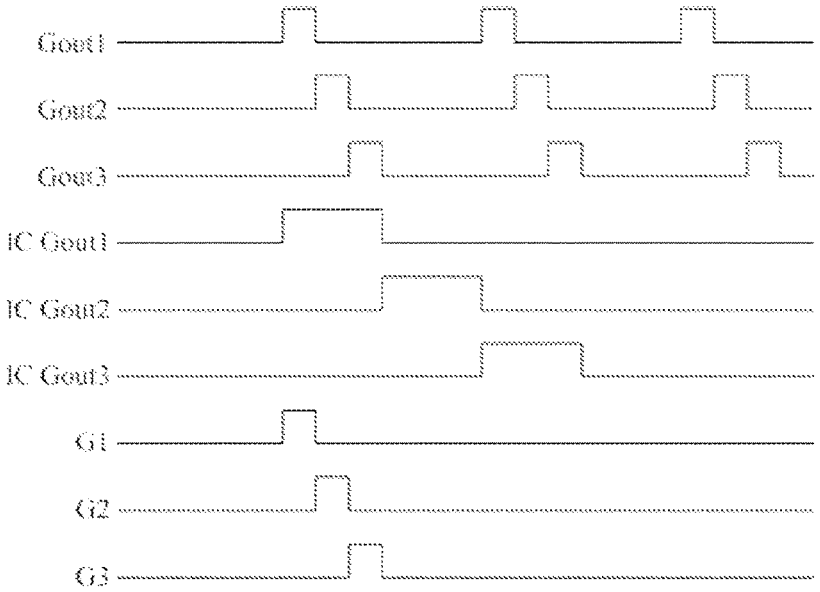
FIG. 5 is a timing diagram of gate scanning signals outputted from the array substrate as shown in FIG. 3.

FIG. 5 is a timing diagram of the gate scanning signals outputted from the array substrate 01 as shown in FIG. 3. As shown in the timing in FIG. 5, when the drive IC 35 inputs the first gate control signal (marked as IC Gout1 in the figure) to the gates of the X first switching transistors, the X first switching transistors are turned on under the control of the corresponding first output pins, and X gate scanning signals (successively marked as G1~GX, in the figure X is equal to 3 as an example) corresponding to the X gate line signal leads are successively outputted. Corresponding to different circuit connection modes, the first gate control signal outputted by the drive IC 35 may also include a plurality of signals for controlling the X first switching transistors to be successively turned on or turned off, thereby achieving a more complex timing control.

An example is taken in which one pixel unit 40 includes three subpixel units 41, the source of T1-1 in each of the first multiplexers 31 may be connected with a first clock line from one pin in the timing controller, the source of T1-2 in each of the first multiplexers 31 may be connected with a second clock line from another pin in the timing controller, and the source of T1-3 in each of the first multiplexers 31 may be connected with a third clock line from still another pin in the timing controller. That is, the total number of pins through which the timing controller in the drive IC 35 outputs the timing signal to the N first multiplexers 31 is three. However, in the prior art, the GOA circuit also needs to be connected with the timing controller, and also the total number of pins for outputting signals from the timing controller to the GOA circuit is three. Therefore, in the foregoing Embodiment 1, the total number of pins through which the timing controller in the drive IC 35 outputs the timing signal to the N first multiplexers 31 is not added. In FIG. 5, when the drive IC 35 inputs the first gate control signal to the gates of the three first switching transistors in each of the first multiplexers 31, the three first switching transistors in each of the first multiplexers 31 are turned on or turned off under the control of the first gate control signal, and successively output the three gate scanning signals Gout1~Gout3 under the control of the timing controller.

The sum of time for successively turning on the three first switching transistors (from the first one to the third one) may be greater than the time for outputting the first gate control signal by the drive IC 35. However, this may cause that the drive time of the array substrate is extended, and that the time difference between the sum of time for successively turning on the three first switching transistors T1-1~T1-3 and the time for outputting the first gate control signal by the drive IC 35 is unavailable for effective display. Therefore, preferably, the time for successively turning on the three first switching transistors (from the first one to the third one)

successively is the first ⅓, the second ⅓ and the third ⅓ of the time for outputting the first gate control signals by the drive IC 35. Specifically, any ⅓ of the time may be 1/(60*3*N), namely, ⅓ of the time 1/(60*N) for a GOA circuit to be connected with one gate line 20 in the prior art.

In the embodiments of the present disclosure, the drive module 30 may adopt the following circuit structure to output signals to the data lines 10, and the drive module 30 includes: M' second multiplexers 32. Each of the second multiplexers 32 is configured to output the data signal to X' data lines 10, where X'*M' is the total number of the data lines 10. The drive module 30 further includes a timing controller comprising X' data signal output pins, and the X' data signal output pins are connected to each of the second multiplexers 32. The second multiplexer 32 includes X' second switching transistors, first electrodes of the X' second switching transistors are correspondingly connected to the X' data signal output pins of the timing controller, second electrodes are correspondingly connected to the X' data lines 10, and a control electrode is connected to a control circuit in the drive module 30. The X' and M' may be any integer. In the following, in order to correspond to the description of outputting by the drive module 30 signals to the gate lines 20, X' in this paragraph is replaced by A*X, and M' in this paragraph is replaced by M/(A*X) for description.

First of all, referring to FIG. 3, starting from the first data line signal lead 11, every A*X data line signal leads 11 arranged in order constitute a set of data line signal leads, wherein A is a positive integer, and M is an integral a plurality of X. The drive module 30 further includes: M/(A*X) second multiplexers 32 successively connected with each set of data line signal leads. Each of the second multiplexers 32 is configured to output corresponding A*X data signals (namely Ss1~Ss A*X, in the figure A*X is equal to 3 as an example) to the A*X data line signal leads 11. If the second multiplexers 32 are not used and the drive IC 35 directly provides the data signal to the data line signal leads 11, the drive IC 35 needs M pins to provide the corresponding data signal, namely more output pins are required. In the embodiments of the present disclosure, the data signals may be provided for M data lines 10 by means of M/(A*X) second multiplexers 32, the total number of output pins through which the drive IC 35 transmits signals to the second multiplexers 32 is M/(A*X), M [1-1/(A*X)] pins are saved and thus the cost of the drive IC is further reduced.

An example is taken in which X is equal to 3 and A is equal to 1, the foregoing first multiplexers 31 and the second multiplexers 32 are employed to educe the gate scanning signals and the data signals at the output end of the drive IC 35. According to the foregoing description, the drive IC 35 only needs to provide, to the array substrate 01, (⅓)M+N output pins for the gate scanning signal and the data signal and some output pins for MIN (Mobile Industry Processor Interface) differential signals. However, in the prior art, in the circuit design where the GOA circuit is employed to provide the gate scanning signals for the gate lines and the MUX design is employed to provide the data signals to the data lines, the total number of pins of the drive IC for the gate scanning signal is 3N, and the total number of pins for the data signal is M. Therefore, by using the circuit design in the foregoing embodiments, after the array substrate is applied to the display panel having M*N resolution, peripheral wirings and bezels at three sides are saved, also ⅔ output pins are reduced, in addition, the overall length of the drive IC is not increased, and thus the cost does not rise.

The following describes the concrete structure of the second multiplexers 32 and a concrete manner through which the drive IC 35 outputs signals to M/(A*X) second multiplexers 32.

As shown in FIG. 3, the drive IC 35 further includes: M/(A*X) second output pins 352 successively outputting M/(A*X) sets of second gate control signals to M/(A*X) second multiplexers 32.

Figure 6:
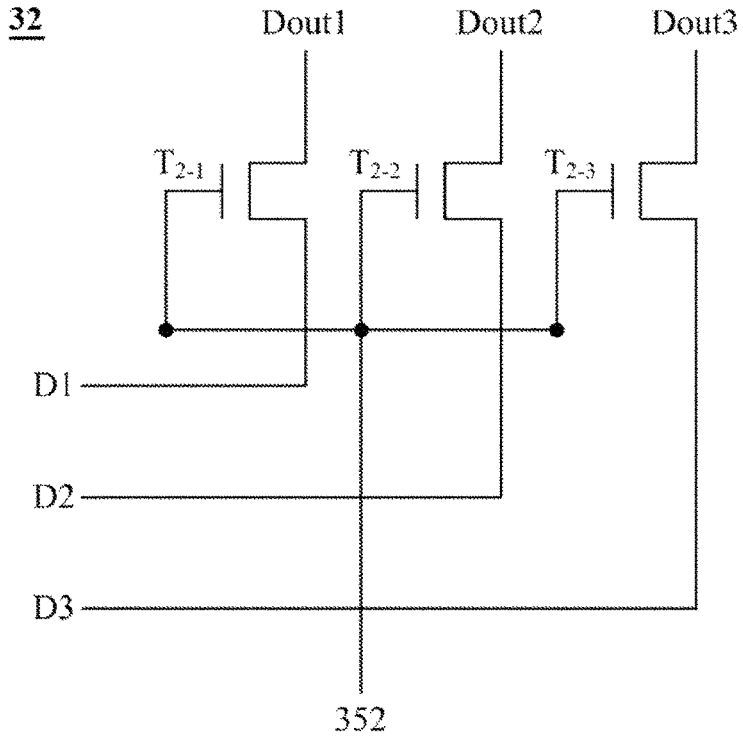
FIG. 6 is a schematic structural diagram of a second multiplexer of the array substrate as shown in FIG. 3.

FIG. 6 is a schematic structural diagram of the second multiplexers 32 of the array substrate 01 as shown in FIG. 3. As shown in FIG. 6, each of the second multiplexers 32 includes A*X second switching transistors (successively marked as T2-1~T2-A*X, in the figure X is equal to 3 and A is equal to 1 as an example), where each of the second output pins 352 is connected with the gates of the A*X second switching transistors. And the timing controller is separately connected with the sources of the A*X second switching transistors to output the corresponding data signals to the sources of the A*X second switching transistors.

Figure 7:
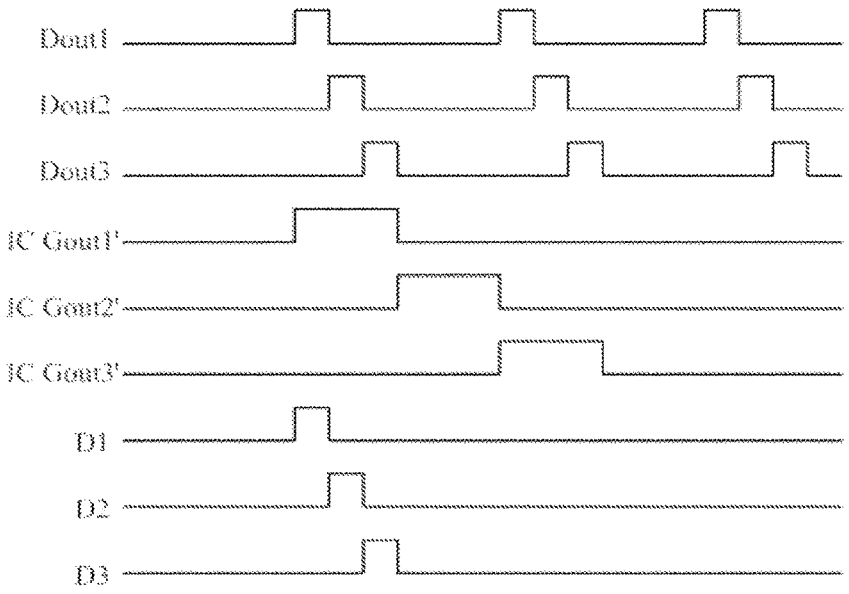
FIG. 7 is a timing diagram of data signals outputted from the array substrate as shown in FIG. 3.

FIG. 7 is a timing diagram of data signals outputted from the array substrate 01 as shown in FIG. 3. As shown in the timing diagram of IC controlling data signal output in FIG. 7, when the drive IC 35 inputs a set of second gate control signals (marked as IC Gout' in the figure, also corresponding to IC Dout in FIG. 3, 8) to the gates of A*X second switching transistors, the A*X second switching transistors are turned on under the control of the corresponding second output pins, and successively output A*X data signals (successively marked as D1~D A*X, in the figure, A*X is equal to 3) corresponding to the A*X data line signal leads 11.

FIG. 4 shows the case in which the second output pins 352 are simultaneously connected with the gates of the A*X second switching transistors and a second gate control signal enables the A*X second switching transistors to be turned on simultaneously. However, the second gate control signal also may be a signal set comprising a plurality of control signals, and a set of second gate control signals outputted from the drive IC 35 may include a plurality of signals controlling the A*X second switching transistors to be successively turned on or turned off, thereby achieving a more complex timing control.

It can be known from the description of the gate scanning signals that the timing controller serves to successively output the gate scanning signals G1~GX, and the clock lines from another A*X pins in the timing controller are connected with the sources of the A*X second switching transistors in the second multiplexers 32 to successively output D1~D A*X data signals.

Specifically, an example is taken in which A*X=1*3, the source of T2-1 in each of the second multiplexers 32 may be connected with a fourth clock line from one pin in the timing controller, the source of T2-2 in each of the second multiplexers 32 may be connected by with a fifth clock line from another pin in the timing controller, and the source of T2-3 in each of the second multiplexers 32 may be connected with a sixth clock line from still another pin in the timing controller.

The timing controller in the prior art is configured to control to provide data signals to the corresponding subpixel units. Therefore, in the foregoing Embodiment 1, compared with the prior art, the total number of pins through which the timing controller in the drive IC 35 outputs the timing signal to the M/(A*X) second multiplexers 32 is not added.

In FIG. 7, when the drive IC 35 inputs a set of second gate control signals to the gates of the three second switching transistors in each of the second multiplexers 32, the three second switching transistors in each of the second multiplexers 32 are turned on or turned off under the control of a set of second gate control signals, and successively output the data signals Dout1~Dout3 under the control of the timing controller.

The sum of time for successively turning on the three second switching transistors (from the first one to the third one) may be greater than the time for outputting a set of second gate control signals by the drive IC 35. However, this may cause that the drive time of the array substrate is extended, and that the time difference between the sum of time for successively turning on the three second switching transistors T2-1~T2-3 and the time for outputting a set of second gate control signals by the drive IC 35 is unavailable for effective display. Therefore, preferably, the time for successively turning on the three second switching transistors (from the first one to the third one) successively is the first ⅓, the second ⅓ and the third ⅓ of the time for outputting a set of second gate control signals by the drive IC 35. Specifically, any ⅓ of the time may be 1/(60*3*N), namely, ⅓ of the time 1/(60*N) for controlling of a drive IC with MUX structure to turn on a data line is in the prior art.

Figure 8:
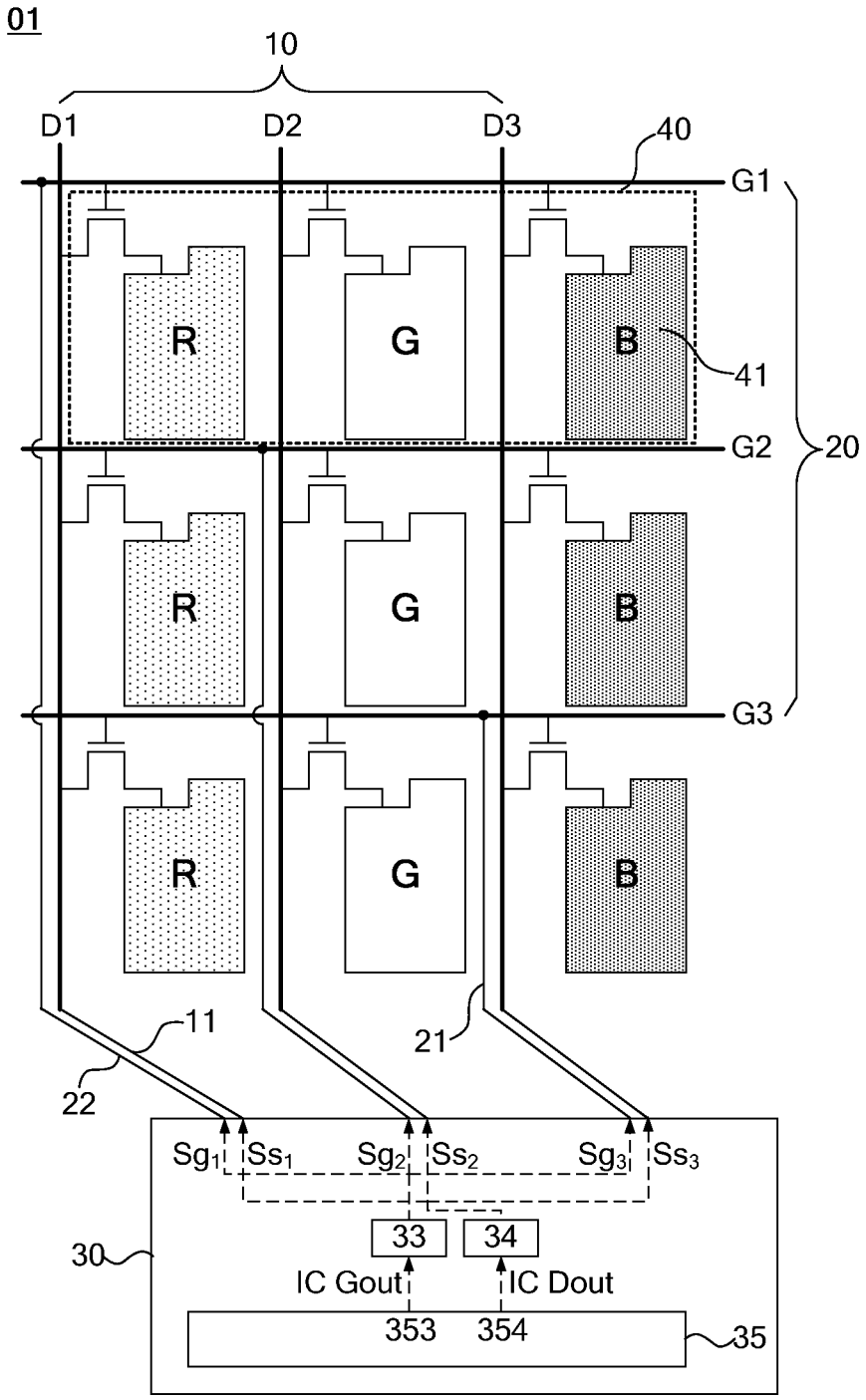
FIG. 8 is a schematic diagram of a second structure of the array substrate as shown in FIG. 2.

FIG. 8 is a schematic diagram of a second structure of the array substrate 01 as shown in FIG. 2. The specific difference between the second structure and the first structure resides in that each of the plurality of pixel units 40 includes X subpixel units 41 arranged along the direction of the data lines 10.

As shown in FIG. 8, the display area 01*a* is further provided with: a plurality of pixel units 40 arranged in an M×N array. Each of the pixel units 40 includes X subpixel units 41 arranged in order along the direction of the gate lines. The total number of the data lines 10 is X*M, and the total number of the gate lines 20 is N, where each of X, N and M is a positive integer. Starting from the first gate line signal lead 22, every B*X gate line signal leads 22 arranged in order constitute a set of gate line signal leads, where B is a positive integer, and N is an integral a plurality of X. The drive module 30 includes: a drive IC 35; and N/(B*X) third multiplexers 33 successively connected with each set of gate line signal leads. Each of the third multiplexers 33 is configured to output corresponding B*X gate scanning signals (successively marked as Sg1~SgB*X, in the figure B*X is equal to 3 as an example) to B*X gate line signal leads. The third multiplexers 33 are the same as the first multiplexers 31 in the first structure in function.

It is to be noted that the foregoing subpixel units continue to use the arrangement mode of subpixels in the prior art. Compared with the arrangement mode of the first structure as previously mentioned, a pixel unit 40 of the second structure is still controlled by X data lines (taking three data lines in FIG. 8 as an example), and it can still achieve the effect of zero bezel at three sides after the array substrate 01 is applied to the display panel.

By means of N/(B*X) third multiplexers 33, the corresponding gate scanning signals may be provided to N gate lines 20. The total number of the pins for transmitting signals from the drive IC 35 to the third multiplexers 33 is N/(B*X).

Here, if the third multiplexers 33 are not used and the drive IC 35 directly provides the gate scanning signal to the gate line signal leads, the drive IC 35 needs N pins to provide the corresponding gate scanning signal, namely more output pins are required, and thus the cost of the drive IC is higher. In the foregoing second structure, due to use of N/(B*X) third multiplexers 33, [1−1/(B*X)]*N pins are saved and thus the cost of the drive IC is reduced.

On the above basis, the following describes the concrete structure of the third multiplexers 33 and a concrete manner through which the drive IC 35 outputs signals to N/(B*X) third multiplexers 33.

See FIG. 8, the drive IC 35 further includes: N/(B*X) third output pins 353 successively outputting N/(B*X) sets of third gate control signals to N/(B*X) third multiplexers 33.

Figure 9:
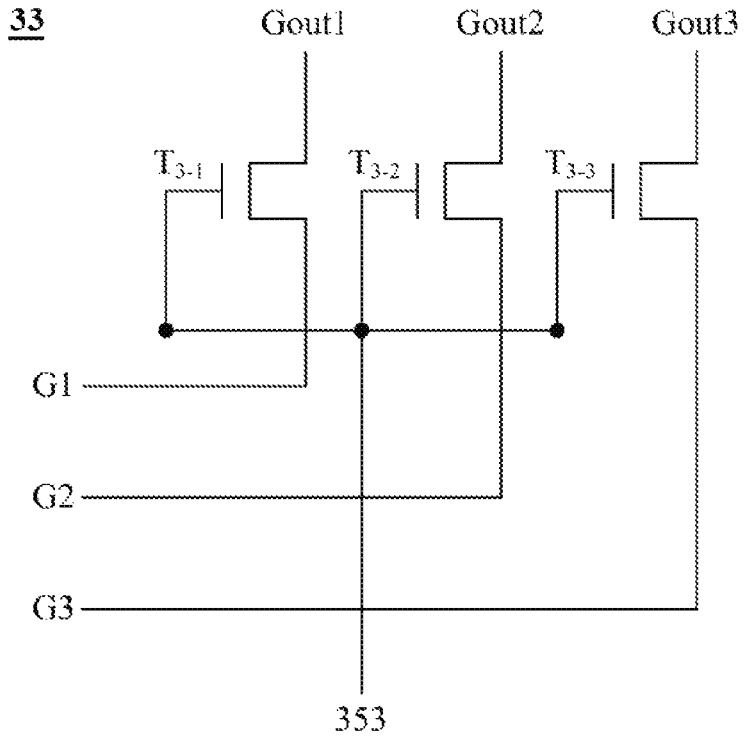
FIG. 9 is a schematic structural diagram of a third multiplexer of the array substrate as shown in FIG. 8.

FIG. 9 is a schematic structural diagram of the third multiplexer 33 of the array substrate 01 as shown in FIG. 8. As shown in FIG. 9, each of the third multiplexers includes B*X third switching transistors (successively marked as T3-1~T3-B*X, in the figure B*X is equal to 3 as an example). One third output pin is separately connected to gates of B*X third switching transistors. The timing controller is separately connected with the sources of the B*X third switching transistors to separately output, to the sources of the B*X third switching transistors, the timing signals Gout~Gout B*X, namely the corresponding gate scanning signals (successively marked as G1~G B*X, in the figure B*X is equal to 3 as an example). Referring to the timing diagram of IC controlling gate output as shown in FIG. 5, when the drive IC inputs a set of third gate control signals to the gates of the B*X third switching transistors, the B*X third switching transistors are turned on under the control of the third output pins, and successively output B*X gate scanning signals corresponding to B*X gate line signal leads.

An example is taken in which one pixel unit 40 includes three subpixel units 41, it is to be noted that a set of third gate control signals outputted from the drive IC 35 include a resultant signal controlling three third switching transistors to be successively turned on or turned off, namely any set of third gate control signals include signals for controlling the gates of three third switching transistors.

The source of T3-1 in each of the third multiplexers 33 may be connected with a first clock line from one pin in the timing controller, the source of T3-2 in each of the third multiplexers 33 may be connected with a second clock line from another pin in the timing controller, and the source of T3-3 in each of the third multiplexers 33 may be connected with a third clock line from still another pin in the timing controller. That is, the total number of pins through which the timing controller in the drive IC 35 outputs the timing signals to the third multiplexers 33 is three. However, in the prior art, the GOA circuit also needs to be connected with the timing controller, and also the total number of pins for outputting signals from the timing controller to the GOA circuit is three. Therefore, in the foregoing second structure, the total number of pins through which the timing controller in the drive IC 35 outputs the timing signals to the N/(B*X) third multiplexers 33 is not added.

The sum of time for successively turning on the three third switching transistors (from the first one to the third one) may be greater than the time for outputting a set of third gate control signals by the drive IC 35. However, this may cause that the drive time of the array substrate is extended, and that the time difference between the sum of time for successively turning on the three third switching transistors T3-1~T3-3 and the time for outputting a set of third gate control signals by the drive IC 35 is unavailable for effective display. Therefore, preferably, the time for successively turning on the three third switching transistors (from the first one to the third one) successively is the first ⅓, the second ⅓ and the third ⅓ of the time for outputting a set of third gate control signals by the drive IC 35. Specifically, any ⅓ of the time may be 1/(60*3*N), namely, ⅓ of the time 1/(60*N) for a GOA circuit to be connected with one gate line 20 in the prior art.

On the above basis, the drive module 30 may use the following specific mode to output signals to the data lines 10: first of all, referring to FIG. 8, starting from the first data line signal lead 11, every X data line signal leads 11 arranged in order constitute a set of data line signal leads. The drive module 30 further includes: M fourth multiplexers 34 successively connected with each set of data line signal leads. Each of the fourth multiplexers 34 is configured to output corresponding X data signals (namely Ss1~SsX, in the figure X is equal to 3 as an example) to the X data line signal leads 11. The fourth multiplexers 34 are the same as the second multiplexers 32 in function.

Here, if the fourth multiplexers 34 are not used and the drive IC 35 directly provides the data signals to the data line signal leads 11, the drive IC 35 needs X*M pins to provide the corresponding data signals, namely more output pins are required.

In the embodiments of the present disclosure, the data signals may be provided to X*M data lines 10 with M fourth multiplexers 34, the total number of output pins through which the drive IC 35 transmits signals to the fourth multiplexers 34 is M, (X−1)*M pins are saved and thus the cost of the drive IC is further reduced.

An example is taken in which X is equal to 3 and B is equal to 1, the foregoing third multiplexers 33 and the fourth multiplexers 34 are employed to alternately educe the gate scanning signals and the data signals at the output end of the drive IC 35, and the drive IC 35 only needs to provide (⅓)N+M output signals and some MIPI signals to the array substrate 01.

On the above basis, the following describes the concrete structure of the fourth multiplexers 34 and a concrete manner through which the drive IC 35 outputs signals to M fourth multiplexers 34.

Referring to FIG. 8, the drive IC 35 further includes: M fourth output pins 354 successively outputting M sets of fourth gate control signals to M fourth multiplexers 34.

Figure 10:
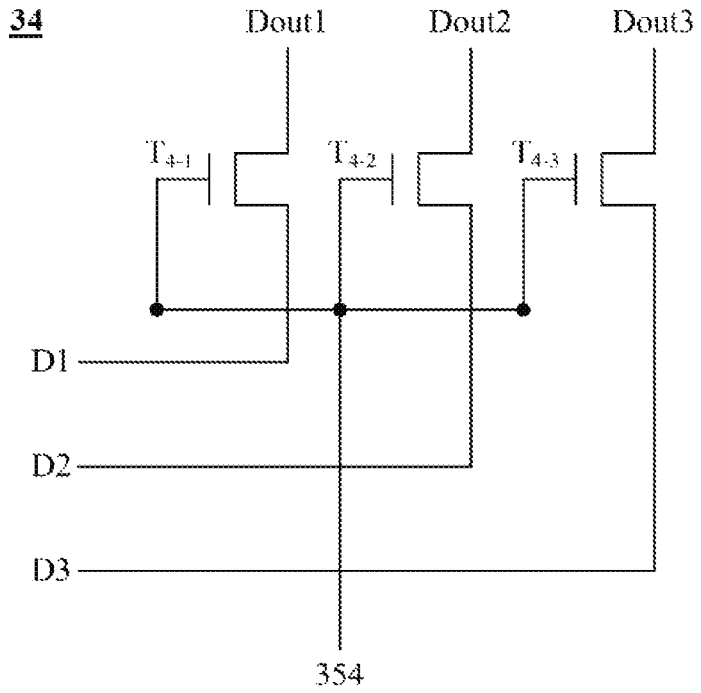
FIG. 10 is a schematic structural diagram of a fourth multiplexer of the array substrate as shown in FIG. 8.

FIG. 10 is a schematic structural diagram of the third multiplexer 34 of the array substrate 01 as shown in FIG. 8. As shown in FIG. 10, each of the fourth multiplexers 34 includes X fourth switching transistors (successively marked as T4-1~T4-X, in the figure X is equal to 3 as an example). Each of the fourth output pins 354 is separately connected to the gates of the X fourth switching transistors. The timing controller is separately connected with the sources of the X fourth switching transistors to separately output, to the sources of the X fourth switching transistors, the timing signals Dout1~DoutX, namely the corresponding data signals (successively marked as D1~DX, in the figure X is equal to 3 as an example). As shown in the timing diagram in FIG. 7, when the drive IC 35 inputs a set of fourth gate control signals to the gates of the X fourth switching transistors, the X fourth switching transistors are turned on under the control of the corresponding fourth output pins 354, and X data signals (successively marked as Dout1~DoutX, in the figure X is equal to 3 as an example) corresponding to the X data line signal leads are successively outputted.

An example is taken in which one pixel unit 40 includes three subpixel units 41, it is to be noted that in the foregoing array substrate 01, any set of fourth gate control signals are taken as an example, a set of fourth gate control signals outputted from the drive IC 35 include a resultant signal controlling three fourth switching transistors to be successively turned on or turned off, namely any set of fourth gate control signals include signals for controlling the gates of three fourth switching transistors.

It can be known from the above description that the timing controller serves to successively output Gout1_GoutB*X gate scanning signals, and the clock lines from another three pins in the timing controller are connected with the sources of the X fourth switching transistors in the fourth multiplexers 34.

In addition, the source of T4-1 in each of the fourth multiplexers 34 may be connected with a fourth clock line from one pin in the timing controller, the source of T4-2 in each of the fourth multiplexers 34 may be connected with a fifth clock line from another pin in the timing controller, and the source of T4-3 in each of the fourth multiplexers 34 may be connected with a sixth clock line from still another pin in the timing controller.

The timing controller in the prior art is configured to provide data signals to corresponding subpixel units. Therefore, in the foregoing second structure, the total number of pins through which the timing controller in the drive IC 35 outputs the timing signal to the M fourth multiplexers 34 is not added.

The sum of time for successively turning on the three fourth switching transistors (from the first one to the third one) may be greater than the time for outputting a set of fourth gate control signals by the drive IC 35. However, this may cause that the drive time of the array substrate is extended, and that the time difference between the sum of time for successively turning on the three fourth switching transistors T4-1~T4-3 and the time for outputting a set of fourth gate control signals by the drive IC 35 is unavailable for effective display. Therefore, preferably, the time for successively turning on the three fourth switching transistors (from the first one to the third one) successively is the first ⅓, the second ⅓ and the third ⅓ of the time for outputting a set of fourth gate control signal by the drive IC 35. Specifically, any ⅓ of the time may be 1/(60*3*N), namely, ⅓ of the time 1/(60*N) for controlling of a drive IC with MUX structure to turn on a data line is in the prior art.

The embodiments of the present disclosure further provide a display panel which includes the foregoing array substrate 01. Here, the foregoing display panel specifically may be an LCD (liquid crystal display) panel or an OLED (Organic Light-Emitting Display) panel.

The embodiments of the present disclosure further provide a display device which includes the foregoing display panel. Here, the foregoing display device specifically may be products or units having any display function, for example, an LCD, an LCD TV, an OLED display, an OLED TV, an electronic paper display, a mobile phone, a tablet computer and a digital photo frame or the like.

It is to be noted that all accompanying drawings in the present invention are abbreviated schematic diagrams of the foregoing array substrate and are merely for a clear description of the structure related to the inventive concept and embodied in this scheme. Other structures unrelated to the inventive concept are existing structures, and are not embodied or merely partly embodied in the accompanying drawings.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. An array substrate, comprising: a display area; and a drive circuit area; wherein the display area includes: a plurality of pixel units arranged in an array; a plurality of data lines arranged in parallel with each other and connected to the plurality of pixel units; and a plurality of gate lines arranged in parallel with each other and connected to the plurality of pixel units; wherein the plurality of data lines intersects with the plurality of gate lines; wherein the drive circuit area includes a drive circuit configured to provide data signals to the plurality of data lines and provide gate scanning signals to the plurality of gate lines, the drive circuit includes N first multiplexers each configured to output the gate scanning signals to X of the plurality of gate lines, the drive circuit includes a timing controller having X gate scanning signal output pins each connected to all of the N first multiplexers, a total number of the plurality of gate lines is X*N, and X and N are positive integers, greater than 1; and wherein the drive circuit area is outside of the display area, is adjacent to one end of the data lines, and is not adjacent to ends of the gate lines.

2. The array substrate of claim 1, wherein each of the N first multiplexers comprises X first switching transistors each having first, second and control electrodes, the first electrodes of the X first switching transistors are connected to the X gate scanning signal output pins of the timing controller, the second electrodes are connected to the X gate lines, and the control electrodes are connected to a control circuit in the drive circuit.

3. The array substrate of claim 2, wherein each of the plurality of pixel units comprises X subpixel units arranged along a direction of the plurality of data lines.

4. The array substrate of claim 1, wherein the drive module comprises M second multiplexers, and each of the second multiplexers is configured to output the data signals to X of the plurality of data lines; and wherein a total number of the plurality of data lines is X*M, and M is a positive integer greater than 1.

5. The array substrate of claim 4, wherein the timing controller includes X data signal output pins, and the X data signal output pins are connected to each of the M second multiplexers.

6. The array substrate of claim 5, wherein each of the M second multiplexers comprises X second switching transistors each having first, second and control electrodes, the first electrodes of the X second switching transistors are connected to the X data signal output pins of the timing controller, the second electrodes are connected to the X data lines, and the control electrodes are connected to a control circuit in the drive circuit.

7. The array substrate of claim 6, wherein each of the plurality of pixel units comprises X subpixel units arranged along a direction of the plurality of data lines.

8. The array substrate of claim 5, wherein each of the plurality of pixel units comprises X subpixel units arranged along a direction of the plurality of data lines.

9. The array substrate of claim 4, wherein each of the plurality of pixel units comprises X subpixel units arranged along a direction of the plurality of data lines.

10. The array substrate of claim 4, wherein X=3.

11. The array substrate of claim 1, wherein each of the plurality of pixel units comprises X subpixel units arranged along a direction of the plurality of data lines.

12. The array substrate of claim 1, wherein X=3.

13. A display panel, comprising the array substrate of claim 1.

14. The display panel of claim 13, wherein the drive circuit comprises M second multiplexers, and each of the second multiplexers is configured to output data signals to X of the plurality of data lines; and wherein a total number of the plurality of data lines is X*M, and M is a positive integer greater than 1.

15. A display device, comprising the display panel of claim 13.

* * * * *